US006449978B2

(12) United States Patent
Sugisaki et al.

(10) Patent No.: US 6,449,978 B2
(45) Date of Patent: Sep. 17, 2002

(54) AIR-CONDITIONING REFRIGERANT RECEIVER

(75) Inventors: Mutsuo Sugisaki, Tochigi; Kenetsu Takenami, Miyagi, both of (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 09/813,295

(22) Filed: Mar. 21, 2001

(30) Foreign Application Priority Data

Mar. 22, 2000 (JP) ..... 2000-84712

(51) Int. Cl.[7] ..... F25B 43/00
(52) U.S. Cl. ..... 62/474; 62/509
(58) Field of Search ..... 62/474, 503, 509

(56) References Cited

U.S. PATENT DOCUMENTS

| | | | | |
|---|---|---|---|---|
| 2,835,114 A | | 5/1958 | Shoemaker et al. | |
| 4,653,282 A | * | 3/1987 | Gueneau | 62/503 |
| 4,707,999 A | * | 11/1987 | Ohta et al. | 62/509 |
| 4,756,166 A | * | 7/1988 | Tomasov | 62/509 |
| 4,768,355 A | * | 9/1988 | Breuhan et al. | 62/474 |
| 4,811,571 A | * | 3/1989 | Mayer | 62/474 |
| 5,184,479 A | | 2/1993 | Koberstein et al. | |
| 5,787,729 A | | 8/1998 | Wijaya | |
| 6,062,039 A | * | 5/2000 | Haramoto et al. | 62/503 |
| 6,223,555 B1 | * | 5/2001 | Schoeder et al. | 62/474 |

FOREIGN PATENT DOCUMENTS

| | | |
|---|---|---|
| EP | 0 276 943 | 8/1988 |
| EP | 0 886 114 | 12/1998 |
| JP | 2-100176 | 8/1990 |
| JP | 10-238906 A | 9/1998 |

* cited by examiner

*Primary Examiner*—William E. Tapelcal
(74) *Attorney, Agent, or Firm*—Arent Fox Kintner Plotkin & Kahn, PLLC

(57) ABSTRACT

In an air-conditioning refrigerant receiver having an annular clearance defined between an outer periphery of a lower cover supporting a contained assembly from the below and an inner periphery of a casing, a guide tube extends downwards to define an annular passage connected to the annular clearance between the guide tube and an inner surface of the casing, and is connected at its upper end to an outer periphery of the lower cover. Thus, a refrigerant, which has passed through the annular clearance, can be guided to a lower portion so as to quietly flow down along the inner surface of the casing, and hence, it is possible to inhibit to the utmost the refrigerant from leaving the inner surface of the casing and to become scattered, thereby more reliably preventing the occurrence of bubbling.

1 Claim, 5 Drawing Sheets

AIR-CONDITIONING REFRIGERANT RECEIVER

BACKGROUND OF THE INVENTION

1. Field of the Invention

The present invention relates to an improvement in an air-conditioning refrigerant receiver used in an air conditioner such as a car air conditioner.

2. Description of the Related Art

Such air-conditioning refrigerant receivers are conventionally known from Japanese Patent Application Laid-open No. 10-238906 and the like.

In the above known refrigerant receiver, in order to prevent a refrigerant, which has passed through a contained assembly, from violently dropping onto a surface of the refrigerant stored in a lower space to produce bubbles, an annular clearance is defined between an outer periphery of a lower cover supporting the contained assembly from the below and an inner periphery of a casing, so that the refrigerant, which has passed through the contained assembly, is permitted to quietly flow down along the inner surface of the casing through the annular clearance. In the above refrigerant receiver, however, the lower cover is formed into a mere circular flat plate shape, and the annular clearance is made at a length corresponding to a thickness of the lower cover. For this reason, it is difficult to permit all of the refrigerant, which has passed through the annular clearance, to quietly flow down along the inner surface of the casing, and a portion of the refrigerant may be scattered inwards from the inner surface of the casing to produce bubbles.

SUMMARY OF THE INVENTION

Accordingly, it is an object of the present invention to provide an air-conditioning refrigerant receiver, wherein the occurrence of bubbling can be prevented more reliably.

To achieve the above object, according to the present invention, there is provided an air-conditioning refrigerant receiver comprising a contained assembly comprised of an upper filter, a desiccant and a lower filter, which are laminated one on another, the contained assembly being sandwiched between upper and lower covers and fixed within a casing, the casing having a refrigerant supply passage and a refrigerant discharge passage provided therein, the refrigerant supply passage leading to an upper space defined within the casing above the upper cover, and the refrigerant discharge passage leading to a lower space defined within the casing below the lower cover, an annular clearance being defined between an outer periphery of the lower cover and an inner periphery of the casing for guiding a refrigerant, which has passed through the contained assembly downwards from the above, into the lower space, wherein the refrigerant receiver further includes a guide tube, which extends downwards to define an annular passage connected to the annular clearance between the guide tube and an inner surface of the casing, the guide tube being connected at an upper end thereof to an outer periphery of the lower cover.

With the above arrangement, the refrigerant, which has passed through the contained assembly, flows through the annular clearance to the lower space within the casing. In this case, the refrigerant, which has passed through the annular clearance, can be guided to a lower portion by the guide tube so as to quietly flow down along the inner surface of the casing, because the guide tube extending downwards and defining the annular passage connected to the annular clearance between the guide tube and the inner surface of the casing is connected at its upper end to the outer periphery of the lower cover defining the annular clearance between the lower cover and the inner periphery of the casing. Thus, it is possible to inhibit to the utmost the refrigerant from leaving the inner surface of the casing and becoming scattered, thereby more reliably preventing the occurrence of bubbling.

The above and other objects, features and advantages of the invention will become apparent from the following description of the preferred embodiment taken in conjunction with the accompanying drawings.

DESCRIPTION OF THE PREFERRED EMBODIMENTS

The present invention will now be described by way of embodiments with reference to the accompanying drawings.

Figure 1:
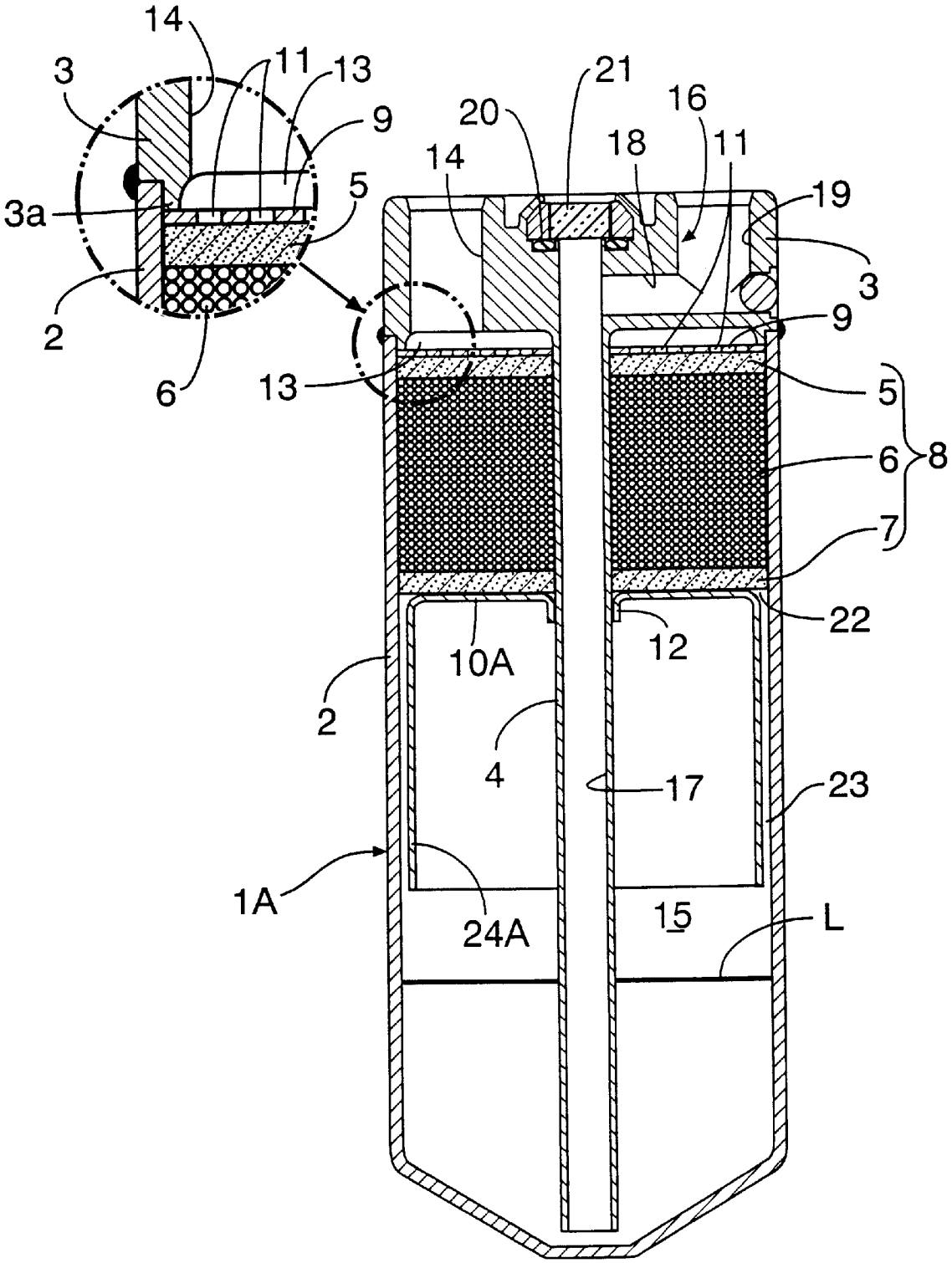
FIG. 1 is a vertical sectional view of an air-conditioning refrigerant receiver according to a first embodiment of the present invention.

FIG. 1 shows a refrigerant receiver according to a first embodiment of the present invention. The refrigerant receiver has a casing 1A comprising a bottomed cylindrical casing body 2 with its lower end closed, and a disk-shaped head 3 closing an opening at an upper end of the casing body 2. A ring-shaped projection 3*a* protruding on a lower surface of the head 3 is fitted into an upper end of the casing body 2, and an outer peripheral portion of a lower end of the head 3 and an outer peripheral portion of an upper end of the casing body 2 are welded to each other. Moreover, the head 3 is formed by forging, and integrally provided with a cylindrical portion 4 disposed coaxially within the casing body 2.

An upper cover 9, an upper filter 5, a desiccant 6, a lower filter 7 and a lower cover 10A are accommodated in a vertically superposed manner in an upper portion of the casing 1A. Specifically, the upper filter 5, the desiccant 6 and the lower filter 7 form a contained assembly 8, which is sandwiched between the upper cover 9 and the lower cover 10A from the above and below.

The upper cover 9 is formed into a flat plate-shape having a large number of punched bores 11 and put into abutment against the projection 3*a* of the head 3 in such a manner that its outer periphery is fitted to the casing body 2 and the cylindrical portion 4 is fitted to its inner periphery. The contained assembly 8 is put into abutment against a lower surface of the lower cover 10A in such a manner that its outer periphery is fitted to the casing body 2 and the cylindrical portion 4 is fitted to its inner periphery. Further, the lower cover 10A is formed into a flat plate shape having a flange portion 12 formed by folding its inner periphery downwards. The flange portion 12 is caulked to the cylindrical portion 4 at a location at which the lower cover 10A with the cylindrical portion 4 fitted to the flange portion 12 abuts against a lower surface of the contained assembly 8. Thus, the contained assembly 8 is clamped between the upper cover 9 abutting against the projection 3*a* of the head 3 and the lower cover 10A fixed in the caulked manner to the cylindrical portion 4.

An upper space 13 is defined in the casing 1A above the upper cover 9, and a refrigerant supply passage 14 for supplying a refrigerant into the upper space 13 is provided in the head 3. A condenser of an air conditioner is connected to the refrigerant supply passage 14. The refrigerant introduced from the condenser via the refrigerant supply passage 14 into the upper space 13 flows through the punched bores 11 in the upper cover 9 toward the contained assembly 8.

A lower space 15 is defined in the casing 1A below the lower cover 10, and a refrigerant discharge passage 16 is provided in the casing 1A to lead to the lower space 15. The refrigerant discharge passage 16 comprises a passage section 17 defined within the cylindrical portion 4 integral with the head 3 to extend vertically, a passage section 18 provided in the head 3 to extend sideways from an upper portion of the passage section 17, and a passage section 19 provided in the head 3 to extend upwards from a portion of the passage section 18 close to an outer end. The refrigerant discharge passage 16 is connected to an expansion valve of the air conditioner.

The refrigerant is stored in the lower space 15, and the lower end of the cylindrical portion 4, i.e., the lower end of the refrigerant discharge passage 16 is set to lie below the level L of the refrigerant in the lower space 15.

A sight glass 21 is mounted to the head 3 immediately above the cylindrical portion 4 with a seal member 20 interposed therebetween, and the situation of the refrigerant within the lower space 15 can be viewed through the sight glass 21.

An annular clearance 22 is defined between the outer periphery of the lower cover 10A and the inner periphery of the casing body 2 of the casing 1A, and a guide tube 24A extends downwards to define an annular passage 23 connected to the annular clearance 22 between the guide tube 24A and an inner surface of the casing body 2 of the casing 1A, and is integrally connected at its upper end to the outer periphery of the lower cover 10A. Moreover, a lower end of the guide tube 24A is set at a location above and close to the level L of the refrigerant in the lower space 15.

The operation of the first embodiment will be described below. The refrigerant liquefied in the condenser of the air conditioner is introduced through the refrigerant supply passage 14 into the upper space 13 within the casing 1A and further flows via the punched bores 11 in the upper cover 9 toward the contained assembly 8. Dusts in the refrigerant flowing downwards within the contained assembly 8 are removed in the upper and lower filters 5 and 7, and water in refrigerant is removed by the desiccant 6.

The refrigerant flowing downwards within the contained assembly 8 flows via the annular clearance 22 toward the lower space 15. In this case, the refrigerant, which has passed through the annular clearance 22, can be guided to a lower portion in the guide tube 24A, so that it quietly flows along the inner surface of the casing body 2, because the guide tube 24A extending downwards to define the annular passage 23 connected to the annular clearance 22 between the guide tube 24A and the inner surface of the casing body 2 is connected at its upper end to the outer periphery of the lower cover 10A defining the annular clearance 22 between the lower cover 10A and the inner periphery of the casing 1A. Therefore, it is possible to inhibit to the utmost the refrigerant from being separated from the inner surface of the casing body 2 to become scattered, thereby more reliably preventing the occurrence of bubbling.

Thus, it is possible to effectively inhibit to the utmost the incorporation of bubbles in the refrigerant stored in the lower space 15, thereby preventing the generation of a noise in the expansion valve or a reduction in cooling ability due to the presence of bubble.

Figure 2:
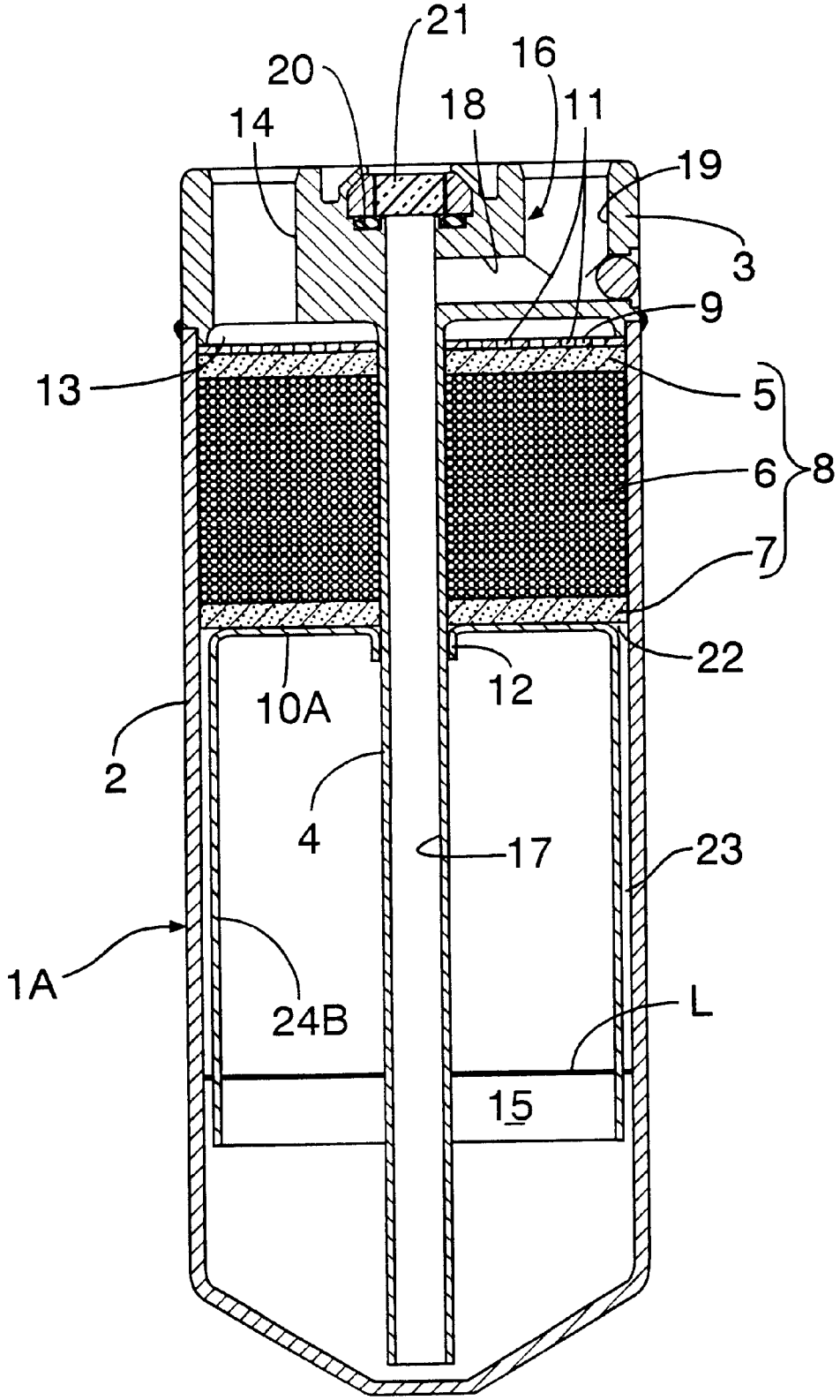
FIG. 2 is a vertical sectional view of an air-conditioning refrigerant receiver according to a second embodiment of the present invention.

FIG. 2 shows a second embodiment of the present invention. In the second embodiment, a lower end of a guide tube 24B connected to the outer periphery of the lower cover 10A may be set at a location lower than the level L of a refrigerant stored in the lower space 15.

Figure 3:
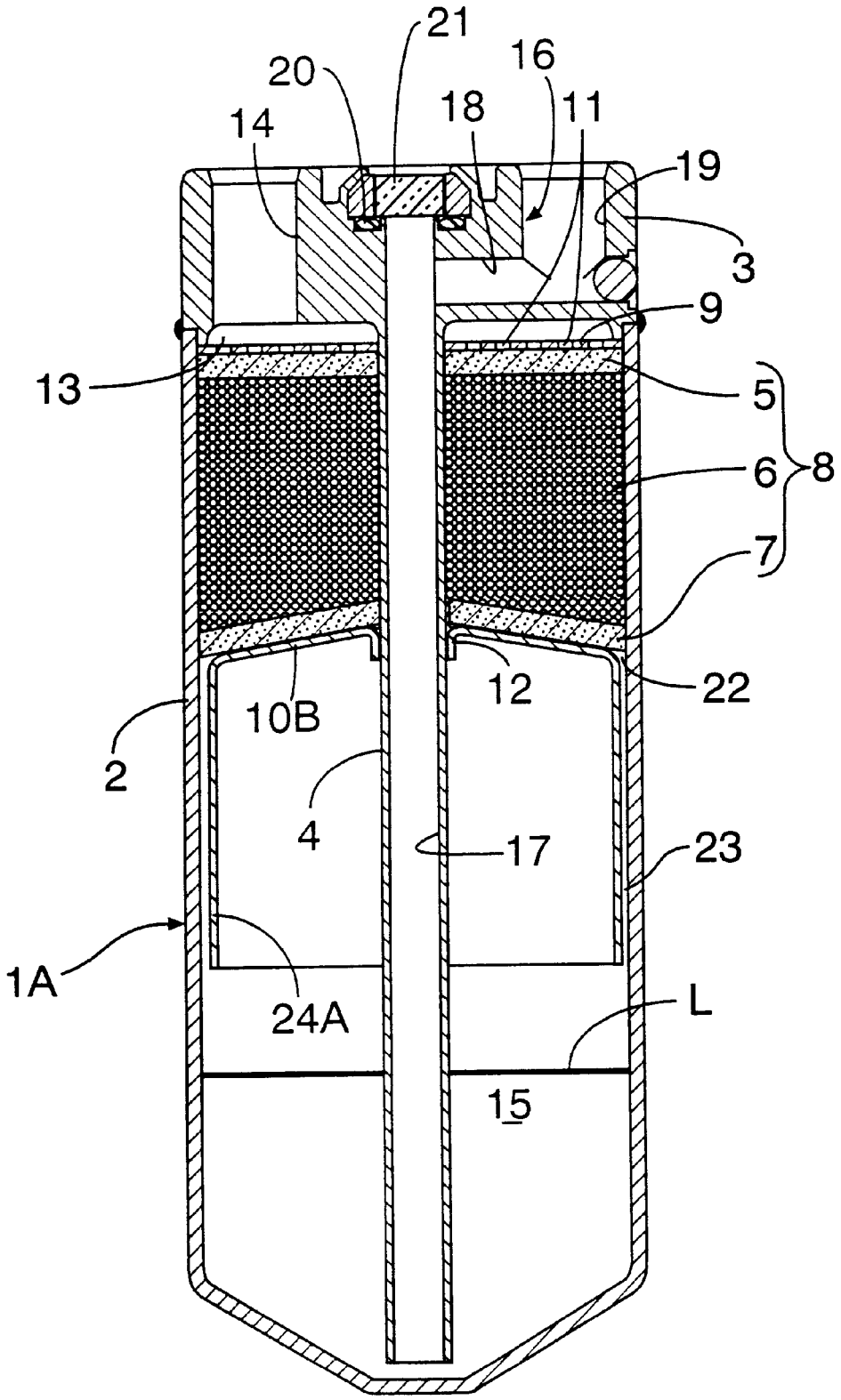
FIG. 3 is a vertical sectional view of an air-conditioning refrigerant receiver according to a third embodiment of the present invention.

In a third embodiment shown in FIG. 3, a lower cover 10B may be formed into such an umbrella shape that its diameter is smaller at a higher location.

Figure 4:
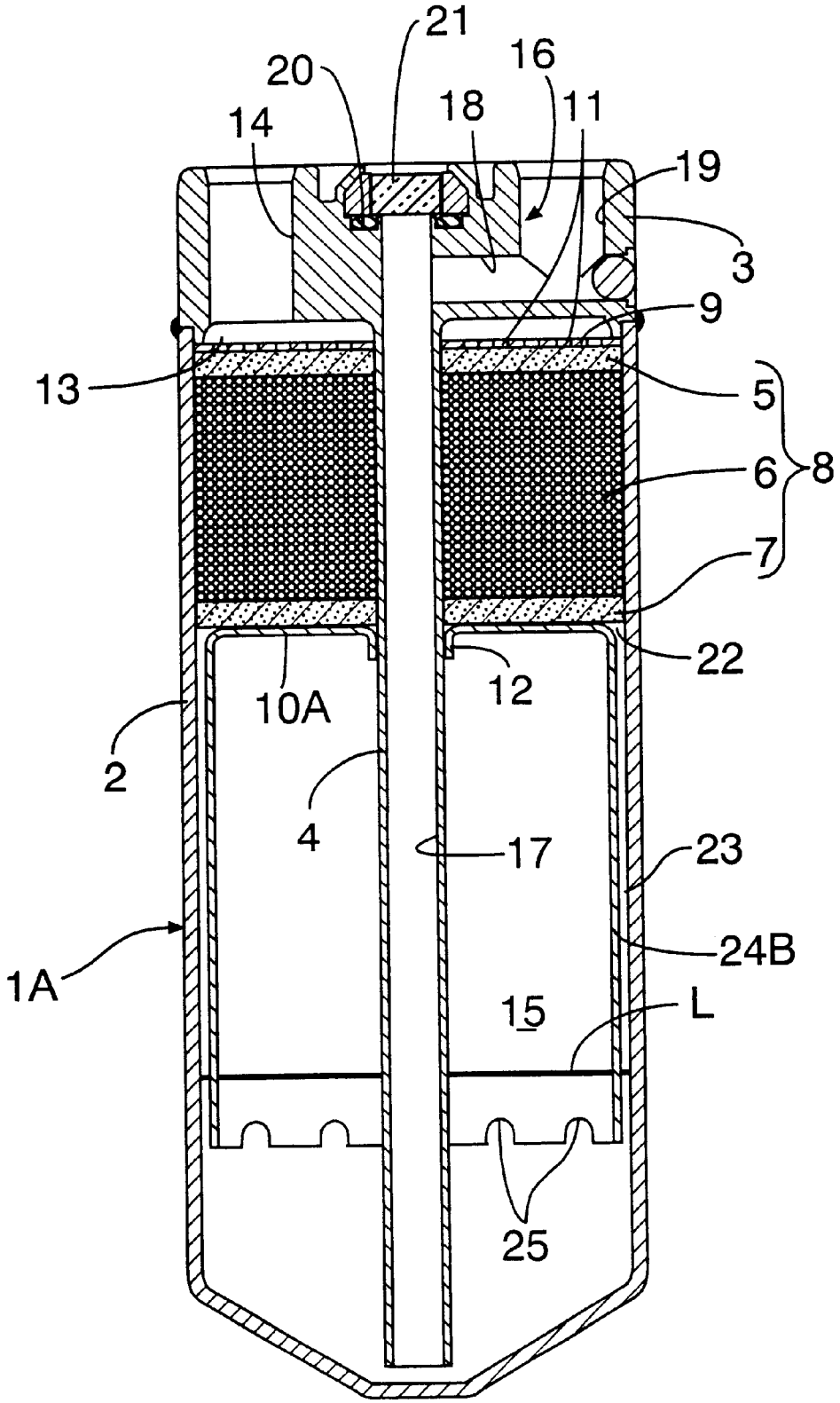
FIG. 4 is a vertical sectional view of an air-conditioning refrigerant receiver according to a fourth embodiment of the present invention.

Further, in a fourth embodiment shown in FIG. 4, a plurality of notches 25 may be provided in a lower end of a guide tube 24B placed at a location lower than the level L of a refrigerant within the lower space 15. According to the fourth embodiment, it is possible to prevent to the utmost bubbles produced in the lower end of the annular passage 23 from entering into the guide tube 24B, thereby more reliably preventing the bubbles from being supplied to the expansion valve.

Figure 5:
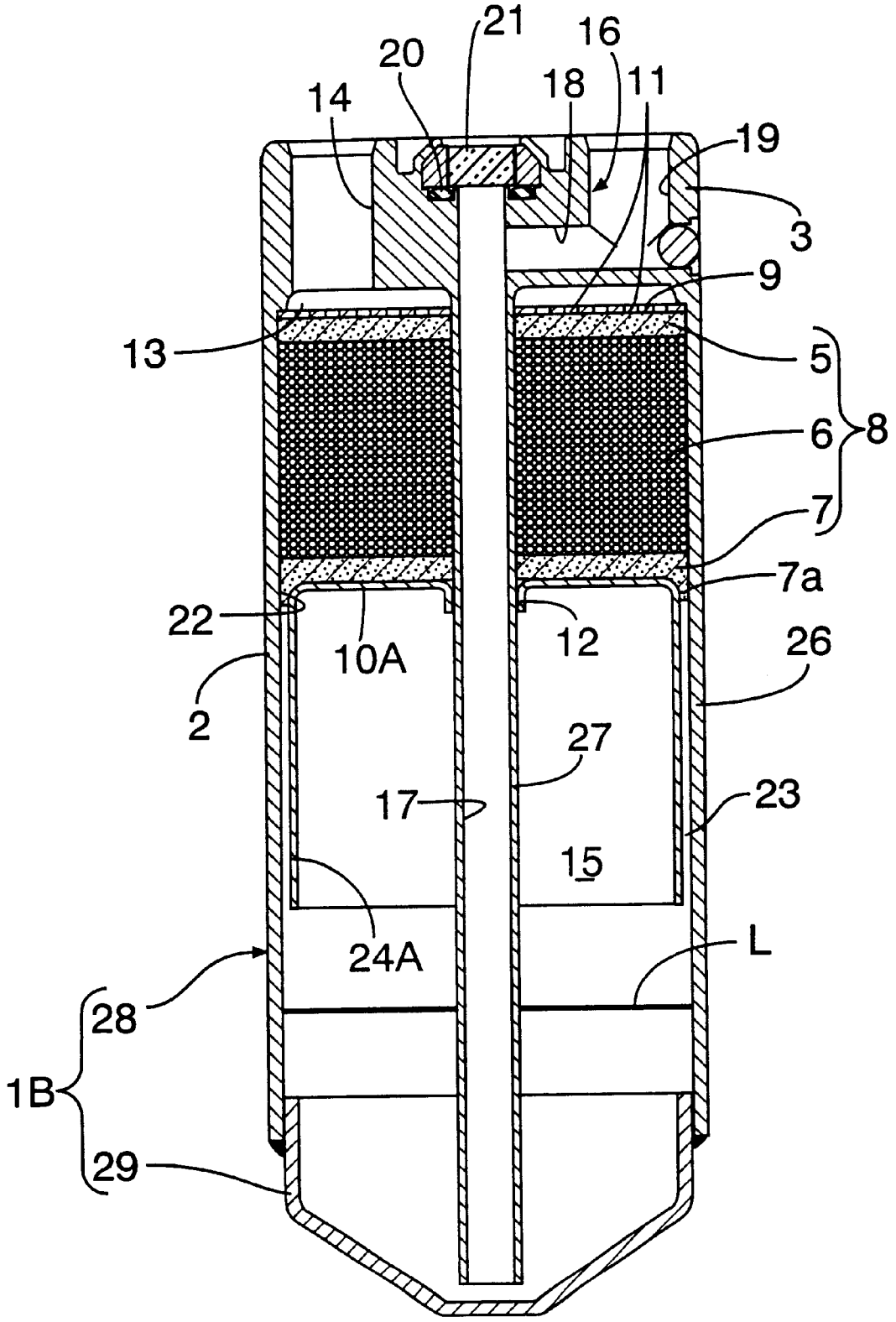
FIG. 5 is a vertical sectional view of an air-conditioning refrigerant receiver according to a fifth embodiment of the present invention.

FIG. 5 shows a fifth embodiment of the present invention. In the fifth embodiment, a downward folded portion 7*a* is formed on an outer periphery of a lower filter 7 and fitted into an annular clearance 22 between an inner periphery of a casing 1B and the lower cover 10A.

When the casing 1B is of a structure similar to each of the first, second, third and fourth embodiments, it is difficult to fit the folded portion 7*a* into the annular clearance 22.

Therefore, the casing 1B is comprised of a casing body 28 formed by forging and integrally provided with a head 3, an outer shell 26 connected to an outer periphery of a lower end of the head 3, and an inner shell 27 formed into the same shape as the cylindrical portion 4 in each of the first to fourth embodiments and connected at its upper end to a central portion of a lower end of the head 3; and a lid member 29 welded to the outer shell 26 to close a lower end of the outer shell 26. The annular clearance 22 and an annular passage 23 are defined between an inner periphery of the outer shell 26 and outer peripheries of the lower cover 10A and the guide tube 24A.

Even according to the fifth embodiment, an effect similar to that in each of the previously described embodiments can be provided.

Although the embodiments of the present invention have been described in detail, it will be understood that the present invention is not limited to the above-described embodiments, and various modifications in design may be made without departing from the spirit and scope of the invention defined in claims.

What is claimed is:

1. An air-conditioning refrigerant receiver comprising a contained assembly comprised of an upper filter, a desiccant and a lower filter, which are laminated one on another, said contained assembly being sandwiched between upper and lower covers and fixed within a casing, said casing having a refrigerant supply passage and a refrigerant discharge passage provided therein, said refrigerant supply passage leading to an upper space defined within said casing above said upper cover, and said refrigerant discharge passage leading to a lower space defined within said casing below said lower cover, an annular clearance being defined between an outer periphery of said lower cover and an inner periphery of said casing for guiding a refrigerant, which has passed through said contained assembly downwards from above, into said lower space, wherein said refrigerant receiver further includes a cylindrical guide tube, which extends downwards to define an annular passage connected to said annular clearance between said guide tube and an inner surface of said casing, said cylindrical guide tube being connected at an upper end thereof to an outer periphery of said lower cover, wherein the refrigerant having passed through said annular clearance is caused to flow downwards along the inner surface of the casing quietly.

* * * * *